US006921778B2

(12) United States Patent
Minkkinen et al.

(10) Patent No.: US 6,921,778 B2
(45) Date of Patent: Jul. 26, 2005

(54) PROCESS FOR CONVERTING SYNTHESIS GAS IN REACTORS THAT ARE ARRANGED IN SERIES

(75) Inventors: Ari Minkkinen, Saint Nom la Breteche (FR); Reynald Bonneau, Villeurbanne (FR); Alexandre Rojey, Rueil Malmaison (FR)

(73) Assignees: Institut Francais du Petrole, Rueil Malmaison Cedex (FR); AGIP Petroli S.p.A., Rome (IT); ENI S.p.A., Rome (IT)

( * ) Notice: Subject to any disclaimer, the term of this patent is extended or adjusted under 35 U.S.C. 154(b) by 59 days.

(21) Appl. No.: 10/300,001

(22) Filed: Nov. 20, 2002

(65) Prior Publication Data

US 2003/0096881 A1 May 22, 2003

(30) Foreign Application Priority Data

Nov. 20, 2001 (FR) ..... 01 15.023
Sep. 27, 2002 (FR) ..... 02 12.043

(51) Int. Cl.[7] ..... C07C 27/00
(52) U.S. Cl. ..... 518/706; 518/705
(58) Field of Search ..... 518/700, 705, 518/706

(56) References Cited

U.S. PATENT DOCUMENTS 4,279,830 A 7/1981 Haag et al.
5,348,982 A * 9/1994 Herbolzheimer et al. ... 518/700
6,156,809 A 12/2000 Clark et al.

FOREIGN PATENT DOCUMENTS

GB 631682 11/1949
WO 01/72928 10/2001

* cited by examiner

*Primary Examiner*—J. Parsa
(74) *Attorney, Agent, or Firm*—Millen, White, Zelano & Branigan, P.C.

(57) ABSTRACT

The invention relates to a process for converting a synthesis gas into liquid hydrocarbons used in at least two reactors that are arranged in series and that contain a catalytic suspension of at least one solid catalyst in suspension in a liquid phase, in which said reactors are essentially perfectly mixed, the last reactor is at least in part fed by at least a portion of at least one of the gaseous fractions that are collected at the outlet of at least one of the other reactors, at least one reactor is fed by a flow of catalytic suspension that is obtained directly from another reactor, and at least one flow of catalytic suspension that is obtained from a reactor is at least in part separated so as to obtain a liquid product that is essentially free of catalyst and a catalytic suspension that is high in catalyst, which is recycled.

20 Claims, 3 Drawing Sheets

PROCESS FOR CONVERTING SYNTHESIS GAS IN REACTORS THAT ARE ARRANGED IN SERIES

PRIOR ART

Figure 1:
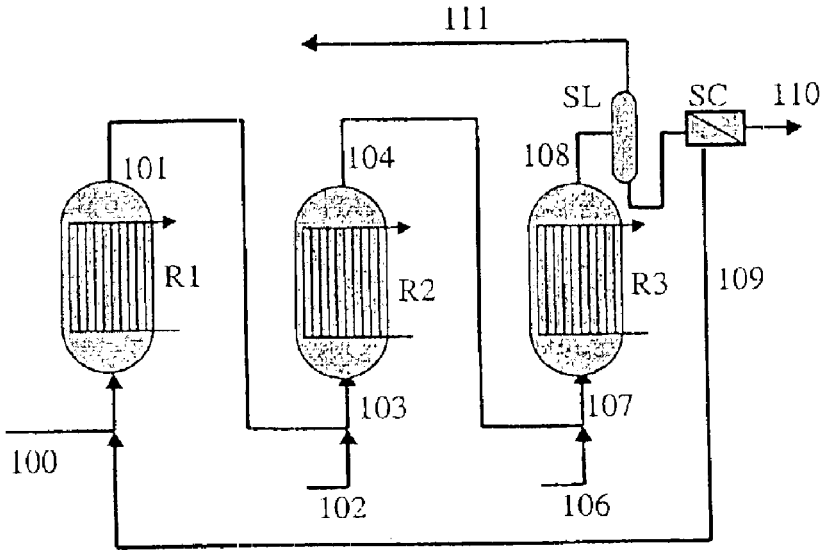

The production of liquid fuels by Fischer-Tropsch synthesis opens up significant prospects for the exploitation of gas deposits that are far from major markets. These developments are conditional upon the necessity of reducing costs and most particularly the investment costs so as to improve the profitability of this field.

One of the ways to attain this objective consists in manipulating a scale factor to reduce the investment costs per ton of liquid product that is obtained.

The implementation of the catalyst that is used to promote the synthesis reaction in suspension form in the liquid phase ("slurry") makes it possible to produce very large reactors of uniform size and to reach very high production levels, for example 10,000 barrels per day with a single three-phase reactor.

Such three-phase reactors comprise a catalyst in suspension in a generally inert solvent in the reaction. They are generally called slurry reactors. Among the different types of slurry reactors are known in particular perfectly stirred autoclave-type reactors or else bubble-column-type reactors that operate under variable hydrodynamic conditions that range from a perfectly stirred reactor to a reactor that is operated in piston mode without dispersion, both for the gaseous phase and for the liquid phase.

Recently, such types of reactors were considered for Fischer-Tropsch synthesis, rather than the conventional fixed-bed reactors that exhibit the drawback of not evacuating as easily the heat that is released by the reaction.

U.S. Pat. No. 5,961,933 and U.S. Pat. No. 6,060,524 thus describe a process and a device that make it possible to operate a bubble-column-type slurry reactor for Fischer-Tropsch synthesis. In these patents, the slurry reactor comprises an internal or external liquid recirculation system, which makes it possible to reach higher productivity levels for each Fischer-Tropsch reactor.

Patent Application WO 01/00.595 describes a process for synthesis of hydrocarbons from synthesis gas in a three-phase reactor, preferably of the bubble-column type, and in which the hydrodynamic conditions of the liquid phase are such that the Péclet number of the liquid phase is greater than 0 and less than 10. Furthermore, the surface velocity of the gas is preferably less than 35 cm.s−1.

Patent EP-B-450 860 describes a method that makes it possible to operate in an optimized manner a bubble-column-type three-phase reactor. This patent seeks to optimize the operation of a single reactor of this type. It is indicated that the performance levels depend essentially on the dispersion of the gaseous phase (Péclet number for the gaseous phase) and keeping the catalyst in suspension in the liquid phase. In particular, the Péclet number for the gaseous phase absolutely must be greater than 0.2. Thus, this patent recommends not using an essentially perfectly stirred reactor as far as the gaseous phase is concerned (Péclet gas number close to 0), because this type of reactor leads to inadequate performance levels.

Thus, such a process comes up against certain limitations that are linked in particular to axial mixture phenomena. To promote the gas-liquid mass transfer and solid liquid mass transfer and heat transfer, it is advantageous to stir vigorously the liquid and gaseous phases that are present, which increases the axial mixing. In addition, for large reactor diameters, for example from 8 to 11 m, significant movements of internal recirculation occur, which bring about a very important mixing of the liquid phase. These phenomena are advantageous in terms of the transfer of the gas-liquid mass and/or liquid-solid mass and of heat transfer, but a very large mixture can hamper the extent to which the reaction progresses.

The process according to the invention aims at overcoming these problems by combining at least two three-phase reactors, preferably at least three three-phase reactors. It was actually observed that the series construction of reactors that are vigorously mixed makes it possible for the reaction to progress correctly while promoting the evacuation of calories. This scheme makes it possible to reach high productivity levels in desired products, i.e., essentially paraffins that essentially have a carbon number that is higher than 5, preferably higher than 10, while limiting the formation of light products (C1–C4 hydrocarbons).

DESCRIPTION OF THE INVENTION

The invention relates to a process for synthesis of hydrocarbons that preferably have at least 2 carbon atoms in their molecule and more preferably at least 5 carbon atoms in their molecule by putting into contact a gas that essentially contains carbon monoxide and hydrogen and in a reaction zone that contains a suspension of solid particles in a liquid that comprises solid catalyst particles of the reaction. Said catalytic suspension is also called slurry. The process according to the invention is therefore used in a three-phase reactor. The process according to the invention will preferably be used in a bubble-column-type three-phase reactor.

The process according to the invention is a process for converting a synthesis gas into liquid hydrocarbons implemented in at least two reactors that are arranged in series, preferably at least three reactors that are arranged in series containing at least one catalyst in suspension in a liquid phase, in which said reactors are perfectly stirred, and the last reactor is at least in part fed by at least a portion of at least one of the gaseous fractions that are collected at the outlet of at least one of said reactors, and the mixture of liquid-phase product and catalyst exiting the last reactor is at least in part separated so as to obtain a liquid product that is essentially free of catalyst and a liquid fraction that is high in catalyst (catalytic suspension that is high in catalyst, or concentrated catalytic suspension), which is recycled.

Each of the reactors that is used is a bubble-column-type reactor with contact of the gas with a very divided liquid/solid mixture ("slurry" reactor or "bubble-column slurry" according to the English terminology).

The catalysts that are used can have very diverse natures and usually contain at least one metal that is preferably selected from among the metals of groups 5 to 11 of the new periodic table.

The catalyst can contain at least one activation agent (also called a promoter) that is preferably selected from among the elements of groups 1 to 7 of the new periodic classification. These promoters can be used alone or in combination.

The substrate is generally a porous material and often a porous inorganic refractory oxide. By way of example, this substrate can be selected from the group that is formed by alumina, silica, titanium oxide, zirconia, rare earths or mixtures of at least two of these porous mineral oxides.

Typically, the suspension can contain 10 to 65% by weight of catalyst. The catalyst particles have a mean diameter that is most often between about 10 microns and about 100 microns. Finer particles optionally can be produced by attrition, i.e., by fragmentation of the initial catalyst particles.

In the process according to the invention, each of the reactors is vigorously mixed and approximates perfect mixing conditions. The reactors according to the invention are therefore defined as being approximately perfectly stirred, and the Péclet number advantageously can be used as a criterion that makes it possible to measure the degree of stirring of said reactors.

Since the reaction takes place in a liquid phase, the control of the hydrodynamics of this phase is fundamental. For each reactor, it is possible to apply the piston-dispersion model to the liquid phase, because it is well adapted to continuous phases. The Péclet number that is linked to this model is Pe liq=VI*H/$D_{ax}$ where VI is the speed of the liquid in the reactor, H is the height of expansion of the catalytic bed, and $D_{ax}$ is the axial dispersion coefficient. It should preferably be less than 10 and more preferably less than 8. Such a model is less well adapted to the representation of the mixture phenomena in the gaseous phase. If it is used even so to interpret a tracer experiment, however, by determining a Péclet number, for example from the variance of the concentration profile at the outlet, it seems that it is possible to attain values that are preferably less than 0.2, preferably less than 0.18, very preferably less than 0.15 and even more preferably less than 0.1, and even less than 0.05 and in some cases less than or equal to 0.03.

These conditions are more easily combined in the case of a reactor with very large diameter, for example greater than 6 meters. It is also possible, however, to attain such conditions in the case of a reactor with a smaller diameter by regulating the hydrodynamic conditions to promote the stirring and therefore the gas-liquid and liquid-solid mass transfers. This stirring can be obtained by all of the means that are known to one skilled in the art, and in particular, for example, by generating recirculation movements of the liquid phase with internal structures in the reactors or outside recirculation means such as recirculation loops.

The mixing action in the gaseous phase will be increased if said gaseous phase is finely dispersed in gas bubbles with a diameter that does not exceed, for example, several millimeters. Such a condition is favorable, moreover, to the reaction kinetics.

To promote the progress of the reaction, in the process according to the invention, reactors that are arranged in series, at least two, but preferably at least three, are used. This makes it possible in addition, and this is another object of this invention, to stagger the injection of synthesis gas. In this way, it is possible to optimize the configuration of the reactors that are arranged in series. In particular, when the goal is to achieve high train capacities to take advantage of economies of scale, in general the maximum diameter of a reactor is limiting because of design and shipping by road. This diameter can be, for example, 11 m. In this case, to maximize the production capacity, it is advantageous to use reactors of the same diameter, and this can be accomplished by adjusting the amount of synthesis gas that is sent into each of the reactors.

Each of the reactors is operated at a temperature of between preferably 180° C. and 370° C., preferably between 180° C. and 320° C., and more preferably between 200° C. and 250° C., and at a pressure of preferably between 1 and 5 MPa (megapascal), preferably between 1 and 3 MPa.

In summary, the process according to the invention is a process for converting a synthesis gas into liquid hydrocarbons that are used in at least two reactors that are arranged in series and that contain at least one catalyst in suspension in a liquid phase, in which said reactors are essentially perfectly mixed, the last reactor is at least in part fed by at least a portion of at least one of the gaseous fractions that are collected at the outlet of at least one of said reactors, and the product mixture in liquid phase and the catalyst exiting the last reactor is at least in part separated so as to obtain a liquid product that is essentially free of catalyst and a catalyst-enriched liquid fraction, which is recycled. The process according to the invention preferably comprises at least 3 reactors that are arranged in series.

In the process according to the invention, the liquid Péclet number is preferably less than 8, and, independently, the gas Péclet number is preferably less than 0.2 and more preferably less than 0.1.

According to a preferred mode of operation of the process according to the invention, at the outlet of each reactor, the gaseous phase is separated from the liquid phase that contains the catalyst in suspension. More preferably, the gaseous fractions that exit from the first reactors are combined, treated and sent to the inlet of the last reactor and very preferably, the gaseous fraction that exits from the last reactor is recycled at the inlet of the synthesis gas production stage.

According to a preferred mode of operation of the process according to the invention, the introduction of synthesis gas is distributed at the inlet of the reactors that are arranged in series such that all of the reactors are identical in size.

The catalyst of the process according to the invention is preferably formed by a porous mineral substrate and at least one metal that is deposited on this substrate. The catalyst is preferably suspended in the liquid phase in the form of particles with a diameter that is preferably less than 200 microns.

Several possible embodiments of the invention are described below. In the figures that are exhibited, the references of the same flow or piece of equipment are identical.

EXAMPLE 1

Several embodiments of the invention are possible, and one of these embodiments is presented in FIG. 1.

In this example of arrangement of the process according to the invention, three reactors that are arranged in series are used. The synthesis gas arrives via pipe 100. It is sent to first reactor R1, in which it is dispersed within the liquid phase that is formed by the products of the reaction that are recycled. At the outlet of this first reactor R1, the formed liquid product mixture that contains the catalyst in suspension (catalytic suspension) as well as the gas that has not reacted are evacuated via pipe 101 in the form of a dispersed phase. Via pipe 102, a second feed of synthesis gas is introduced, and the resulting mixture is sent via pipe 103 to second reactor R2. At the outlet of this second reactor R2, the liquid product mixture that contains the catalyst in suspension as well as the gas that has not reacted are evacuated via pipe 104 in dispersed-phase form. Via pipe 106, a third synthesis gas feed is introduced, and the resulting mixture is sent via pipe 107 to third reactor R3. At the outlet of this third reactor R3, the mixture of liquid product that contains the catalyst in suspension as well as the gas that has not reacted are evacuated via pipe 108 in dispersed-phase form. The gaseous phase is separated from the liquid phase in separator SL. This gaseous phase is evacuated via pipe 111, treated and recycled. The liquid phase that contains the catalyst in suspension (catalytic suspension) is sent to the separation and filtration system SC. The liquid phase that is separated from the catalyst is evacuated via pipe 110 while the catalyst-concentrated liquid phase (concentrated catalytic suspension) is recycled via pipe 109 to first reactor R1.

EXAMPLE 2

Figure 2:
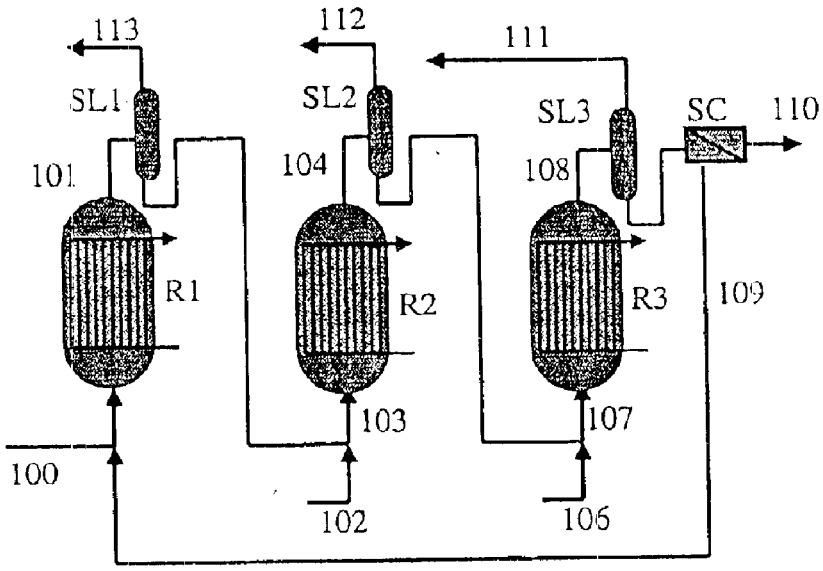

In the process according to the invention, intermediate separations can optionally be carried out. In particular, it is possible to separate the residual gaseous fraction at the outlet of each reactor, as the diagram of FIG. 2 shows it.

The residual gaseous fractions are separated at the outlet of each of the reactors by means of separators SL1, SL2 and SL3.

This prevents sending cover gases and water that contain residual gaseous fractions that exit from one reactor to the next reactor. Separators SL1, SL2, and SL3 operate, for example, by decanting, by providing an adequate dwell time in the separating tank. The gaseous fractions that are thus collected via pipes 111, 112 and 113 are combined, treated and recycled.

The gaseous fractions that are collected via pipes 111, 112, and 113 contain water, carbon dioxide, light hydrocarbons as well as a mixture of carbon oxide and hydrogen. It is advantageous to send the mixture of carbon oxide and hydrogen that is collected at the outlet of one reactor to the next reactor (not shown).

The other flows or devices are identical to those of FIG. 1.

EXAMPLE 3

Figure 3:
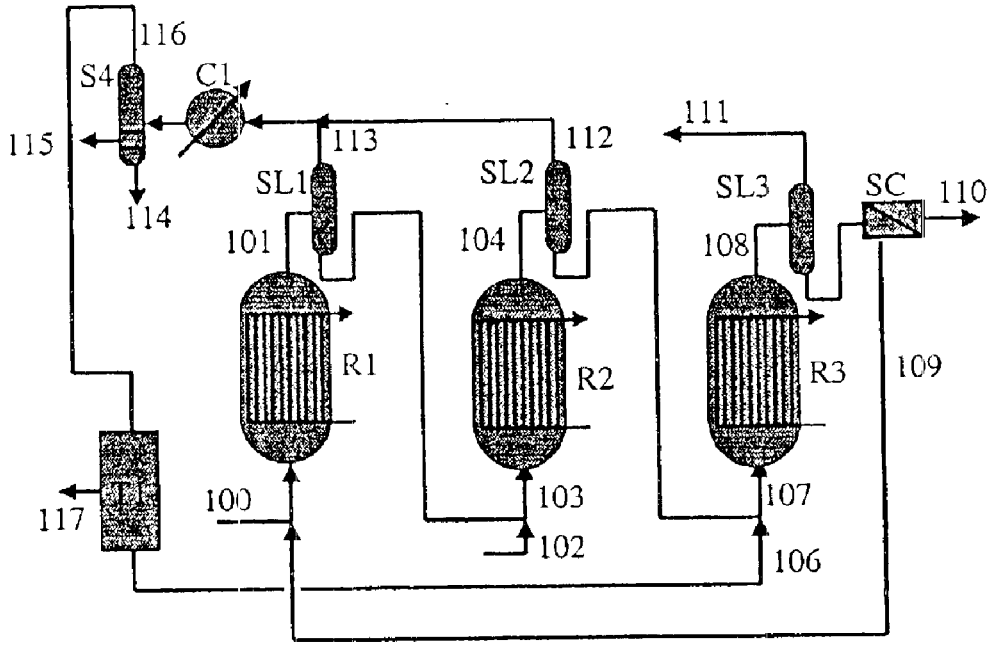

In the case of the embodiment that is depicted in FIG. 3, the gaseous fractions that are collected via pipes 112 and 113 at the outlet of reactors R1 and R2 are combined and treated. The gaseous mixture is first cooled in exchanger-condenser C1 so as to condense the water. A mixture of three phases that are separated in separator S4 is thus obtained: an aqueous phase that is evacuated via pipe 114, a liquid hydrocarbon phase that is evacuated via pipe 115, and a gaseous phase that is evacuated via pipe 116. The gaseous phase is sent to a treatment section T1 so as to separate at least in part the carbon dioxide that it contains. The carbon-dioxide-rich gaseous fraction, which is thus separated, is evacuated via pipe 117. Treatment section T1 can use the various known processes for separating the carbon dioxide. It is possible to use, for example, a process for washing by a solvent, such as, for example, an amine, or else a physical solvent, such as refrigerated methanol, propylene carbonate or dimethyl ether of tetraethylene glycol (DMETEG). It is also possible to use any other process that is based on, for example, a separation by adsorption or a separation by selective membrane. The gaseous mixture that is obtained, which is evacuated from treatment unit T1 via pipe 106, is high in carbon oxide and hydrogen. It also contains light hydrocarbons, in particular methane. It is sent to the inlet of the last reactor R3. It optionally can be mixed with an addition of a mixture of carbon oxide and hydrogen, obtained from the synthesis gas production section (not shown). The light hydrocarbons that arrive via pipe 106 and that are not converted in reactor R3 are evacuated via pipe 111 and can be recycled at the inlet of the synthesis gas production section.

EXAMPLE 4

Figure 4:
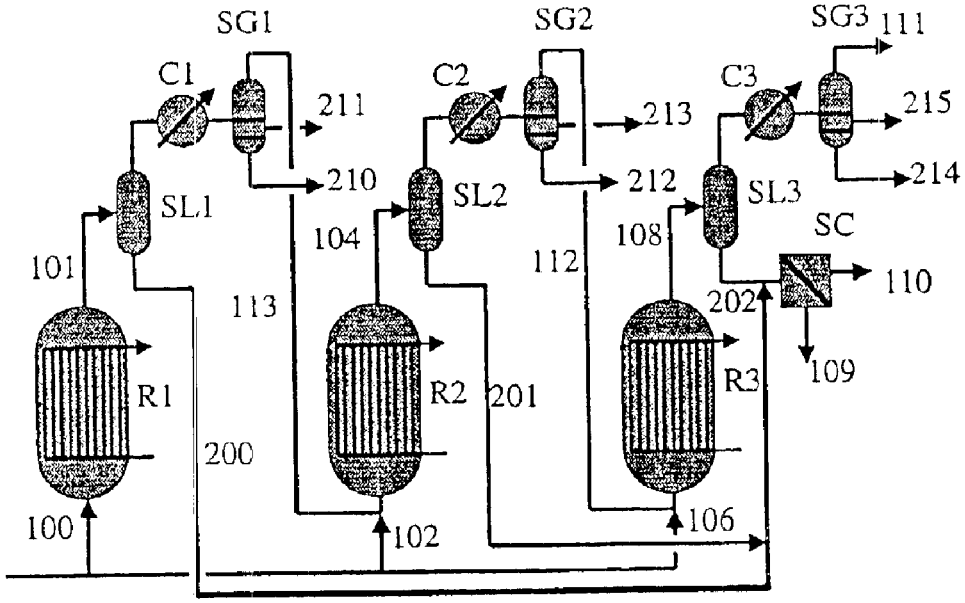

In FIG. 4, another possible arrangement example is exhibited:

The synthesis gas is sent to first reactor R1 via pipe 100. At the outlet of reactor R1, the gaseous phase and the liquid phase are separated in separator SL1. The gaseous phase that exits from separator SL1 is cooled in exchanger C1. This refrigeration results in the condensation of an aqueous phase and the evacuation of this condensed phase via pipe 210; furthermore, a condensed phase of light hydrocarbons is evacuated via pipe 211. The resulting gaseous phase is evacuated via pipe 113 and sent to reactor R2 by being mixed at the inlet of reactor R2 with an addition of synthesis gas that arrives via pipe 102. At the outlet of reactor R2, the gaseous phase and the liquid phase are separated in separator SL2. The gaseous phase that exits from separator SL2 is cooled in exchanger C2. This refrigeration results in the condensation of an aqueous phase and the evacuation of this condensed phase via pipe 212, and, furthermore, a condensed phase of light hydrocarbons that is evacuated via pipe 213. The resulting gaseous phase is evacuated via pipe 112 and sent to reactor R3, with an addition of synthesis gas arriving via pipe 106. At the outlet of reactor R3, the gaseous phase and the liquid phase are separated in separator SL3. The gaseous phase that exits from separator SL3 is cooled in exchanger C3. This refrigeration results in the condensation of an aqueous phase and in the evacuation of this condensed phase via pipe 213; furthermore, a condensed phase of light hydrocarbons is evacuated via pipe 214.

The liquid products that exit from separators SL1, SL2 and SL3 via pipes 200, 201, and 202, containing the catalyst in suspension (catalytic suspensions), are sent in a mixture into separator SC, in which the liquid products that are evacuated via pipe 110 are separated from a catalyst-concentrated liquid phase (concentrated catalytic suspension), which is recycled to reactors R1, R2 and R3.

In the diagram of FIG. 4, separators SL1, SL2 and SL3 appear as separate from reactors R1, R2 and R3. The gaseous phase that exits from each reactor could, as an alternative, be separated from the liquid phase that contains the catalyst in suspension in the reactor itself, whereby the liquid phase that contains the catalyst can then be evacuated with the level being monitored.

EXAMPLE 5

Figure 5:
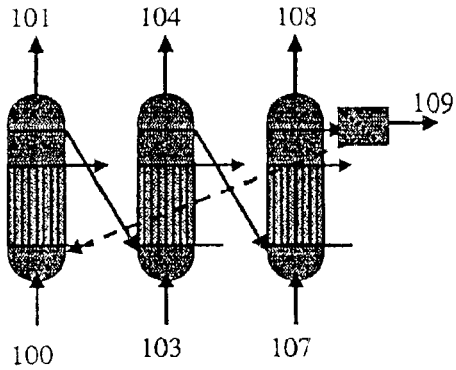

This example describes an embodiment that allows the circulation of the catalyst between the various reactors. FIG. 5 exhibits the corresponding diagram.

Whereby each reactor is vigorously mixed, the catalyst that is introduced at the base of each reactor is distributed homogeneously in the entire liquid phase that occupies the reactor. In the embodiment that is shown in FIG. 5, the unconverted gaseous fraction is released at the top of each reactor and the liquid phase that contains the catalyst in suspension (catalytic suspension) overflows and circulates toward the base of the next reactor by simple gravity. The transfer lines that ensure the passage from one reactor to the next reactor should be designed so as exhibit the most uniform slope possible. The liquid phase collects at the outlet of the last reactor and is at least partially separated from the catalyst that it contains and is filtered. It is then evacuated via pipe 110. The catalyst that remains in suspension in a residual liquid phase (concentrated catalytic suspension) is recycled with this liquid phase to the first reactor via the line that is shown in dotted form.

Such an embodiment can also be implemented in the cases where the devices for separating and in particular for releasing the gaseous phase are implemented at the outlet of each of the reactors as is illustrated in Examples 2, 3 and 4.

At the outlet of each of the reactors, it is also possible to carry out a separation between the liquid phase that is produced and a catalyst-concentrated liquid phase that is returned to the reactor. Instead of a single separation device SC, in such a case as many separation devices as reactors will be used.

Figure 6:
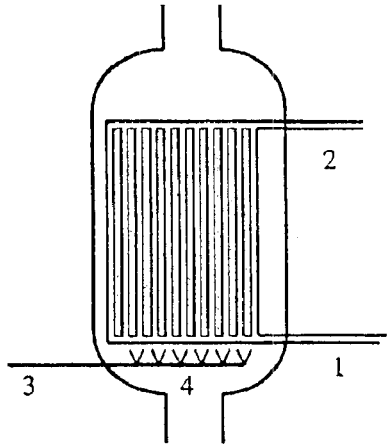
Figure 7:
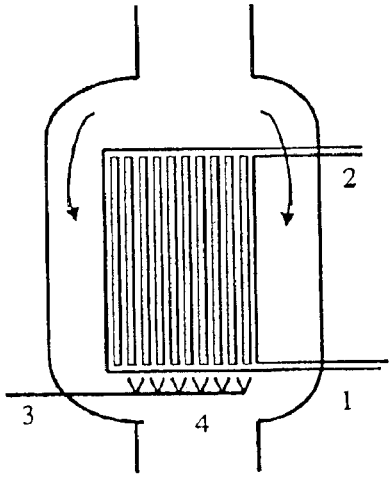

FIGS. 6 and 7 exhibit two reactor arrangement diagrams with circulation that can be used in the process according to the invention. These reactors comprise an internal exchanger that consists of, for example, preferably tubular cooling bundles.

These reactors have a feed and an outlet, whereby the water returns via pipe 1, and the vapor that is generated exits via pipe 2. A system for dispersion of feedstock 4 is also placed inside the reactor. It can be a distributor plate of the gaseous feedstock (synthesis gas) that is fed via line 3. The liquid feed that comprises the catalyst in suspension optionally can be carried out via the same line, whereby the gas/liquid/solid mixture is produced upstream, as is the case in FIGS. 6 and 7. It is also possible to use separate feeds, only the gas that feeds dispersion system 4. In FIG. 7, internal recirculation is promoted by the design of the reactor.

EXAMPLE 6

Figure 8:
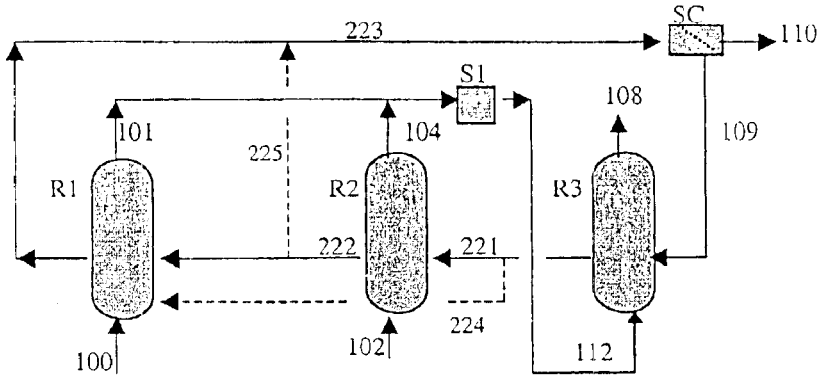

FIG. 8 depicts another method for arrangement of reactors according to the invention, with particular circulation of the catalyst: as in Example 3, the installation comprises two (first) reactors R1, R2 that operate in parallel with the synthesis gas that is fed via lines 100 and 102, and a reactor R3 that operates in series with R1, R2, using the non-transformed residual synthesis gas that is obtained from reactors R1 and R2 via lines 101 and 104. This residual synthesis gas, or first stage gas, is (advantageously) treated in unit S1 essentially to eliminate the water, and optionally carbon dioxide, before feeding reactor R3 via line 112. Section S1 can thus correspond to devices C1 and S4 of FIG. 3, optionally with the addition of treatment section Ti that is shown in this same figure. The particular arrangement of the installation of FIG. 8, relative to the installation of FIG. 3, relates to the circulation of the catalyst, i.e., of the catalytic suspension of at least one solid catalyst in a liquid phase that typically consists of products of the reaction. This catalytic suspension circulates at least in part in countercurrent between the different reactors, whereby a flow of catalytic suspension circulates from last reactor R3 (last relative to the circulation of the synthesis gas) to a first reactor R2 via line 221. Another catalytic suspension flow circulates from reactor R2 to reactor R1 via line 222. A third catalytic suspension flow circulates from reactor R1 to reactor R3, via line 223, separation section SC, then line 109 in which a (relatively more) concentrated catalytic suspension circulates, whereby a pure liquid flow was evacuated via line 110.

As an alternative, reactor R1 is not fed by a catalytic suspension that is obtained from R2 but by a catalytic suspension that is obtained from R3, circulating at the beginning of line 221 then in dotted line 224, whereby the flow of catalytic suspension that is evacuated from reactor R2 is, in this alternative, sent to section SC via line 222, then dotted line 225, then line 223.

In these two configurations, a suspension flow circulates (directly, i.e., without crossing a separation section) from (or from a) last reactor R3, to a preceding or first reactor R1 or R2 (relative to the circulation of synthesis gas), and a relatively concentrated suspension flow that is obtained from a separation section SC feeds the last or a last reactor R3.

One advantage of these configurations results from the fact that last reactor R3 operates with a concentration of the catalytic suspension that is higher than that of preceding or first reactor(s) R1 and/or R2. Actually, the mean concentration (of catalyst) of the catalytic suspension in reactor R3 is less than that of the suspension that feeds R3 via line 109 because of the production of liquid products in R3. In a more general way, a catalytic suspension that leaves a reactor is less concentrated than the catalytic suspension that feeds this same reactor. The advantage of having a relatively more concentrated catalytic suspension in the last reactor is that this makes it possible to compensate for less favorable operating conditions. On the one hand, reactor R3, being downstream from R1 and R2, operates under a lower pressure than that of R1 and R2. On the other hand, the synthesis gas is low in reagents (H2/CO) in reactors R1, R2 and high in inert products by the reaction, in particular methane. Consequently, because of these two phenomena, the partial pressure of reagents (H2/CO) is considerably lower in the last (or a last) reactor R3 than in a preceding or first reactor R1, R2. The use of a catalytic concentration that is relatively higher than the (or a) last reactor makes it possible to compensate for the influence of this lower partial pressure and to be able to maintain a high conversion in the last stage. The mass percentage of catalyst can be, for example, between 20 and 35% by weight, in particular between 25 and 32% by weight in first reactors R1, R2. In reactor R3, the mass percentage of catalyst can be multiplied by a factor K of between 1.03 and 1.25, in particular between 1.06 and 1.20 and, for example, between 1.08 and 1.18 relative to the percentage(s) of first reactor R1, or first reactors R1, R2.

Often, in one or the other of the different configurations that are described in the preceding figures, or according to other configurations that are not described but are obvious to one skilled in the art, at least one reactor (R1, R2, or R3) is fed (typically directly, i.e., without intermediate fractionation of the type of a liquid/catalytic suspension separation) by a catalytic suspension flow that is obtained from another reactor.

In general, an installation for implementing the process according to the invention (according to one of the configurations of the preceding figures or other configurations that are obvious to one skilled in the art), at least one reactor is fed by a catalytic suspension flow that is obtained directly from another reactor, and at least one catalytic suspension flow that is obtained from a reactor is at least in part separated so as to obtain a liquid product that is essentially free of catalyst and a catalytic suspension that is high in catalyst (concentrated), which is recycled. Typically, each of the reactors is linked with at least one other reactor via a suspension flow that is sent directly to this other reactor or that is obtained directly from this reactor.

Often, the catalytic suspension that is high in catalyst is recycled to the last reactor (for example R3) so as to enrich the catalytic suspension of this last reactor relative to that (those) of other reactors, for example of one or more reactors (R1, R2).

The process can comprise in particular a first reaction stage that is carried out in several first reactors that operate in parallel, in which the gaseous fractions that exit from these first reactors are combined, treated, and sent to the inlet of a last reactor. The conversion that is carried out in the first reactors can be determined so that all of the reactors are of identical size.

Various modifications that are obvious to one skilled in the art can be used without exceeding the scope of the invention: in particular and by way of nonlimiting examples, the number of "first reactors" or "last reactor(s)" can be different, for example between 1 and 8. The number of reaction stages can be between 1 and 5. Reactors R1, R2 and R3 that are described above can be replaced by reaction zones, optionally integrated in a smaller number of reactors, etc.

EXAMPLE 7

This example exhibits a material balance of an embodiment according to FIG. 4.

A flow of 713 t/h of synthesis gas arrives via pipe 100, and the molar composition of said synthesis gas is as follows:

| | |
|---|---|
| Water | 0.004 |
| Hydrogen | 0.672 |
| CO | 0.311 |
| Methane | 0.013 |

The process that is used comprises 3 reactors R1, R2 and R3 that are essentially perfectly mixed and that have Péclet numbers of between 0.02 and 0.03.

Reactor R1 operates at a temperature of 236° C. At the outlet of reactor R1, after separation, 66 t/h of liquid products that comprise 87% by molar fraction of components and whose molecule comprises at least 10 carbon atoms is collected via pipe 200. After the gaseous phase is cooled, 234 t/h of water (pipe 210), 67 t/h of condensed hydrocarbons (pipe 211) and 347 t/h of synthesis gas at a pressure of 2.8 MPa, which is sent to reactor R2 via pipe 113 by being mixed with 327 t/h of synthesis gas that arrives via pipe 102, are recovered.

At the outlet of reactor R2, after separation, 63 t/h of liquid products is collected via pipe 101. After the gaseous phase is cooled, 224 t/h of water is recovered via pipe 12; 76 t/h of condensate is recovered via pipe 213; and 311 t/h of synthesis, which is sent to reactor R3 by being mixed with 239 t/h of synthesis gas that arrives via pipe 106, is recovered via pipe 112.

At the outlet of reactor R3, 58 t/h of liquid products is collected via pipe 202. After the gaseous phase is cooled, 205 t/h of water, 75 t/h of condensate and 266 t/h of synthesis gas are recovered.

The overall conversion yield reaches 91%.

It is possible to carry out this example with reactors of different sizes. It is also possible to use reactors of identical size by adapting the temperatures and conversions into liquid products used for reactors R1, R2 and R3, combined with the synthesis gas distribution. The adaptation of conditions for increasing the relative size of a given reactor that makes it possible to obtain these conditions can be carried out by increasing the relative flow rate of synthesis gas at the inlet of this reactor and/or by increasing the conversion in this reactor and/or by reducing the temperature of this reactor. Preferably only the first two parameters are manipulated, whereby the temperature of the three reactors remains essentially identical. In the preceding example, the cited conditions can be obtained with reactors of identical size that operate at similar pressures (differing only by pressure drops) and kept at the same temperature of 236° C.

In the above description and in the claims, the term "essentially" is meant to be synonymous with "substantially" in the expression "essentially perfectly mixed". As a quantitative guide to the meaning of the phrase, a gas Péclet number generally less than about 0.2 correlates with substantially perfect mixing.

As to the apparatus and the technique which can provide the desired mixing, reference is made to U.S. Pat. No. 5,348,982 which corresponds to EP-B-450860. Generally, a lower reactor height/diameter ratio coupled with a higher gas velocity will result in the desired general (<0.2) and preferred (<0.1) Péclet number.

The preceding examples can be repeated with similar success by substituting the generically or specifically described reactants and/or operating conditions of this invention for those used in the preceding examples.

The entire disclosures of all applications, patents and publications, cited herein and of corresponding French application Nos. 01/15023, filed Nov. 20, 2001, and 02/12043, filed Sep. 27, 2002, are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A process for converting a synthesis gas into liquid hydrocarbons in at least two reactors arranged in series and ending with a last reactor, said reactors containing at least one solid catalyst in suspension in a liquid phase, and wherein said reactors are essentially perfectly mixed, said process comprising feeding the last reactor at least in part with at least a portion of at least one of the gaseous fractions collected at an outlet of at least one other reactor, feeding at least one reactor with a flow of catalyst suspension obtained directly from another reactor, separating at least in part, at least one flow of catalyst suspension obtained from a reactor so as to obtain a liquid product essentially free of catalyst and a catalyst suspension enhriched in catalyst, and recycling the enriched catalyst suspension to at least one said reactor, wherein the gas Péclet number is less than 0.18, and the diameter of the reactors is greater than 6 meters.

2. A process according to claim 1, in of the reactors is linked with at least one other reactor via a suspension flow that is sent directly to this other reactor or that is obtained directly from this reactor.

3. A process according to claim 1, in which said catalytic suspension enriched in catalyst is recycled to the last reactor (R3), so as to enrich the catalytic suspension of this last reactor relative to one or more other reactors.

4. A process according to claim 1, comprising a first reaction stage carried out in several first reactors that operate in parallel, in which the gaseous fractions exiting from these first reactors are combined, treated and sent to the inlet of the last reactor.

5. A process according to claim 4, in which the conversion that is carried out in the first reactors is determined such that all of the reactors are identical in size.

6. A process according to claim 1, in which the gas Péclet number is less than 0.15.

7. A process according to claim 1, in which the gas Péclet number is less than 0.05.

8. A process according to claim 1, in which gas Péclet number is less than 0.1.

9. A process according to claim 1, in which at an outlet of each reactor, a gaseous phase is separated from the liquid phase that contains catalyst in suspension.

10. A process according to claim 1, wherein the catalyst comprises a porous mineral substrate and at least one metal deposited on said substrate, and the catalyst is suspended in the liquid phase in the form of particles having a diameter of less than 200 microns.

11. A process according to claim 1, in which the distribution of the introduction of synthesis gas at the inlet of the reactors that are arranged in series is determined so as to allow the use of reactors of identical size.

12. A process according to claim 1, further comprising recycling a gaseous fraction exiting from the last reactor to a stage for production of said synthesis gas, and feeding said resultant synthesis gas to said reactors.

13. A process according to claim 1, in which the gas Péclet number is less than 0.03.

14. A process according to claim 1, in which the diameter of the reactors is up to 11 meters.

15. A process according to claim 1, in which the diameter of the reactors is 8 to 11 meters.

16. A process according to claim 1, in which the diameter of the reactors is 11 meters.

17. A process for converting a synthesis gas into liquid hydrocarbons in at least two reactors arranged in series and ending with a last reactor, said reactors containing at least one solid catalyst in suspension in a liquid phase, and wherein said reactors are essentially perfectly mixed, said process comprising feeding the last reactor at least in part with at least a portion of at least one of the gaseous fractions collected at an outlet of at least one other reactor, feeding at least one reactor with a flow of catalyst suspension obtained directly from another reactor, separating at least in part, at least one flow of catalyst suspension obtained from a reactor so as to obtain a liquid product essentially free of catalyst and a catalyst suspension enriched in catalyst, and recycling the enriched catalyst suspension to at least one said reactor, wherein each of the at least two reactors are stirred, in which the gas Péclet number is less than 1, and in which the diameter of the reactors is greater than 6 meters.

18. A process according to claim 17, wherein stirring is achieved by internal structures in the reactor and/or re-circulation loops.

19. A process according to claim 17, in which the gas Péclet number is less than 1.

20. A process according to claim 17, in which the diameter of the reactors is greater than 6 meters.

* * * * *

UNITED STATES PATENT AND TRADEMARK OFFICE

CERTIFICATE OF CORRECTION

PATENT NO. : 6,921,778 B2
DATED : July 26, 2005
INVENTOR(S) : Ari Minkkinen

It is certified that error appears in the above-identified patent and that said Letters Patent is hereby corrected as shown below:

Column 10,
Line 46, reads "in of the" should read -- in which each of the --.

Signed and Sealed this

Twenty-fifth Day of October, 2005

JON W. DUDAS
*Director of the United States Patent and Trademark Office*